United States Patent [19]

Hunt

[11] 4,022,417

[45] May 10, 1977

[54] CHAIR SUPPORT STRETCHER

[76] Inventor: Shelley M. Hunt, Sans Souci Drive, Pawling, N.Y. 12564

[22] Filed: Feb. 25, 1976

[21] Appl. No.: 661,373

[52] U.S. Cl. ..... 248/440; 297/445

[51] Int. Cl.[2] ..... F16M 11/32

[58] Field of Search ..... 248/440; 297/445, 449

[56] References Cited

UNITED STATES PATENTS

| | | | |
|---|---|---|---|
| 515,382 | 3/1894 | Vankirk et al. | 248/440 X |
| 611,882 | 10/1898 | Wisler | 297/445 X |
| 2,325,537 | 7/1943 | Pease | 248/440 X |

*Primary Examiner*—James C. Mitchell

[57] ABSTRACT

A chair includes a seat connected to legs of the type having tenons that extend upwardly through the seat and are flush on their top surfaces with adjacent areas of the seat. To prevent the legs from being driven upwardly through the seat due to excessive wear or forces, support stretchers are connected between pairs of the legs and the underside of the seat. Additionally, the stretchers provide mutual, lateral support between the front and rear legs and provide horizontal support to the seat for greater weight bearing ability.

7 Claims, 2 Drawing Figures

CHAIR SUPPORT STRETCHER

BACKGROUND OF THE INVENTION

1. Field of the Invention

This invention relates to improvements in the construction of chairs of the type having a seat connected to legs in such a manner that the upper parts of the legs extend upwardly through the seat.

2. Prior Art

A conventional form of chair known in the prior art comprises a seat supported on four legs. The upper ends of the legs extend through the seat and have upper surfaces that are flush with adjacent areas of the seat. When chairs of this type are used, the weight of a person sitting on the seat produces forces that tend to push the legs upwardly through the seat. But, any actual movement is normally prevented due to the combined forces in the joints resulting from adhesion of glue, friction and positive abatment between mating parts. However, as chairs grow old through use, the joints tend to loosen with the result that the legs may be forced upwardly through the seat slightly thereby causing the upper surfaces of the legs to be positioned above adjacent areas of the seat and produce unsightliness and discomfort.

SUMMARY OF THE INVENTION

The principal object of the invention is to improve the construction of chairs of the type discussed above by providing a support stretcher that is so constructed and arranged as to prevent the legs from being driven upwardly through the seat.

Another object is to provide a support stretcher that increases the strength and sturdiness of the chair.

Still another object is to provide mutual, lateral support between the front and rear legs.

A further object is to increase the weight bearing ability of the chair seat.

Other objects and advantages of the invention will be apparent from the following description taken in connection with the accompanying drawing wherein:

FIG. 1 is a perspective view from the underside of a chair embodying the invention; and, FIG. 2 is an enlarged side elevational view, partly in section and with portions removed, illustrating further details of the invention.

DETAILED DESCRIPTION

Figure 1:
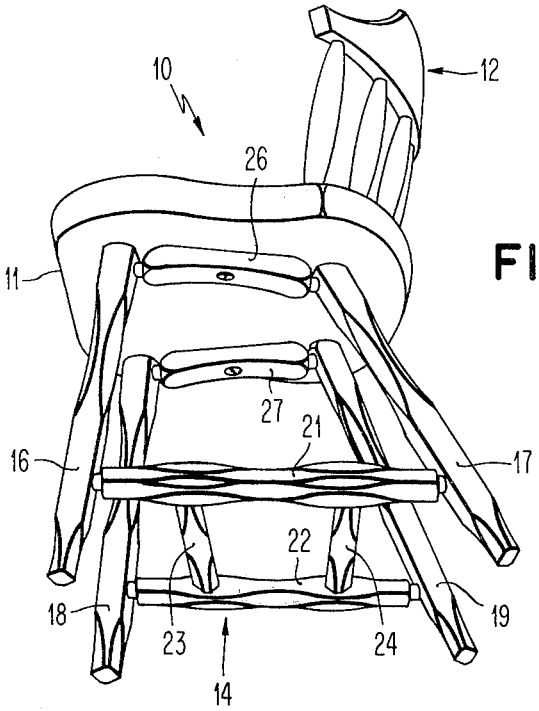

Referring now to the drawing, a wooden chair 10 comprises a seat 11, a back 12 and an underframe 14 constructed to represent an "Early American" style or appearance.

Underframe 14 comprises four legs 16 – 19 connected to seat 11, four rungs 21 – 24 connected to the legs and to each other and, in accordance with the present invention, two support stretchers 26 and 27 connected to the legs and seat. Except for stretchers 26 and 27 and the cooperation therewith, the chair is of conventional construction.

Figure 2:
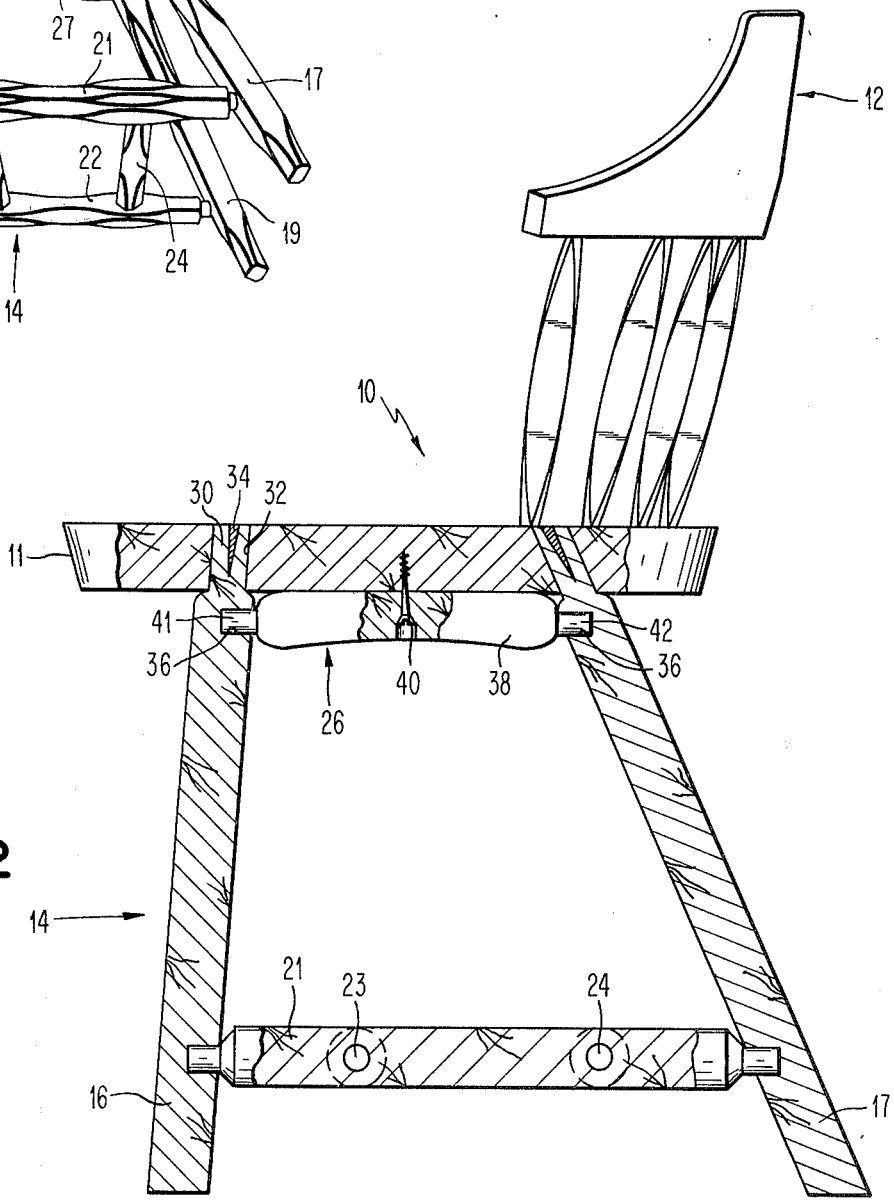

Each of the legs 16 – 19 is of similar construction so only one need be described in detail. With reference to FIG. 2, leg 16 has an upper end portion or tenon 30 of a reduced width that is fitted into and extends through a hole 32 in seat 11. Portion 30 is cut and has a conventional, hardwood wedge 34 driven therein to expand portion 30 against the side walls of hole 32. The upper surfaces of portion 30 and wedge 34, and hence of leg 16, are flush with the surrounding upwardly facing surface of seat 11. Beneath the underside of seat 11, leg 16 has a transverse blind hole 36 of circular cross section that receives one end of stretcher 26.

Each of stretchers 26 and 27 is similar so only one need be described. As best shown in FIG. 2, stretcher 26 includes a main body portion 38 the upper surface of which abuts the undersurface of seat 11. A wood screw 40 fastens stretcher 26 to seat 11. The stretcher also includes two ends 41 and 42 of reduced width and circular cross section, the ends being fitted into holes 36 of legs 16 and 17 and secured by glue. Stretcher 16 is made of wood wherein the wood fibers extend longitudinally along the stretcher. Stretcher 16 thus extends between legs 16 and 17 beneath seat 11 and is connected thereto. The resultant arrangement obviously increases the rigidity, sturdiness and strength of the chair. Any vertical forces that tend to move the legs upwardly are not only taken up by the legs-to-seat joints but also by the legs-to-stretcher-to-seat joints.

To assemble a chair of the above construction, the underframe is first loosely assembled either without glue or with a glue that has not set. When fitted initially without glue, the glueing is done after assembly. The mating parts or joints are constructed with loose tolerances, as is conventional in the art, so as to allow assembly to occur readily and easily. Ends 41 and 42 are first fitted into legs 16 and 17. Then legs 16, 17 are pushed upwardly into the mating holes in the seat, the loose tolerances allowing the legs and stretcher to be moved relative to each other. The stretcher is then jammed against the underside of seat 11 and fastened by screw 40. Wedges 34 are then driven into the upper ends of the legs, and the seat, legs and wedges can then be sanded to produce the flush surfaces. The other parts of the chair are assembled in conventional manner.

It should be obvious to those skilled in the art that various changes by way of addition, omission or alteration can be made in details of the chair without departing from the spirit and scope of the invention as defined in the appended claims.

What is claimed is:

1. In a chair having a seat and at least two legs joined to said seat, said seat having two cylindrical vertical holes extending completely through said seat, said legs having upper cylindrical ends fitted into said holes and extending through said seat whereby the upper surfaces of said legs and seat are flush, said legs having transverse cylindrical holes opening towards each other and located immediately beneath said seat, a support stretcher extending between and joined to said legs beneath said seat, said stretcher having a medial body portion abutting the underside of said seat and end portions fitted into said holes in said legs, whereby said stretcher is operative to prevent said upper ends of said legs from working upwardly through said seat due to prolonged usage and wear.

2. The invention of claim 1 including screw means fastening said medial body portion to said seat.

3. In a chair having a seat provided with four spaced vertical cylindrical holes passing through said seat, four spaced vertical legs connected to said seat and having upper cylindrical tenons passing through said holes and terminating at upper surfaces thereof flush with adjacent areas of said seat, the improvement comprising two support stretchers each connected to the underside of said seat and to different pairs of said legs, each of said stretchers comprising a medial body portion having an upwardly facing surface abutting against and shaped similar to the underside of said seat, each stretcher further comprising end portions of reduced cross section, each pair of said legs having transverse holes therein located immediately beneath said seat, said end portions of said stretcher connected thereto being fitted into said holes in said legs, and means fastening said end portions to said legs whereby said stretchers are operative to prevent said tenons from working upwardly through said seat to thereby dislocate said flush surfaces.

4. The invention of claim 3 wherein each stretcher is of wood having the fibers thereof extending generally longitudinally between said end portions and said legs.

5. The invention of claim 4 wherein said fastening means comprises glue.

6. The invention of claim 5 wherein said holes in said legs are blind holes extending transversely across said legs adjacent to but spaced from the underside of said seat.

7. The invention of claim 6 comprising screw means extending through abutting surfaces of said medial body portions and said seat and operative to fasten said stretchers to said seat.

* * * * *